US012007205B2

(12) United States Patent
Sipes, Jr.

(10) Patent No.: US 12,007,205 B2
(45) Date of Patent: Jun. 11, 2024

(54) COMPACT LASER SYSTEM FOR DIRECTED ENERGY APPLICATIONS

(71) Applicant: OPTICAL ENGINES INC., Colorado Springs, CO (US)

(72) Inventor: Donald Lee Sipes, Jr., Colorado Springs, CO (US)

(73) Assignee: OPTICAL ENGINES INC., Colorado Springs, CO (US)

( * ) Notice: Subject to any disclaimer, the term of this patent is extended or adjusted under 35 U.S.C. 154(b) by 0 days.

(21) Appl. No.: 18/219,475

(22) Filed: Jul. 7, 2023

(65) Prior Publication Data

US 2024/0102775 A1 Mar. 28, 2024

Related U.S. Application Data

(63) Continuation of application No. 17/697,085, filed on Mar. 17, 2022, now Pat. No. 11,713,946.

(60) Provisional application No. 63/162,651, filed on Mar. 18, 2021.

(51) Int. Cl.
*F41H 11/02* (2006.01)
*F41H 13/00* (2006.01)

(52) U.S. Cl.
CPC ..... *F41H 11/02* (2013.01); *F41H 13/005* (2013.01)

(58) Field of Classification Search
CPC ..... F41H 11/02; F41H 13/005
USPC ..... 89/1.1
See application file for complete search history.

(56) References Cited

U.S. PATENT DOCUMENTS

| | | | | |
|---|---|---|---|---|
| 8,581,771 | B2 * | 11/2013 | Bradley | F41H 13/0062 342/13 |
| 8,927,935 | B1 * | 1/2015 | Meline | F41H 13/0062 250/340 |
| 10,509,213 | B1 * | 12/2019 | Monari | G02B 15/163 |
| 10,880,035 | B2 * | 12/2020 | Bradley | H04K 3/822 |
| 10,901,074 | B1 * | 1/2021 | Pan | G01S 17/89 |
| 10,907,940 | B1 * | 2/2021 | Parker | G06N 20/00 |
| 2012/0098693 | A1 * | 4/2012 | Bradley | F41H 13/005 342/14 |
| 2017/0359554 | A1 * | 12/2017 | Madhav | H04N 7/185 |
| 2020/0108924 | A1 * | 4/2020 | Smith | F41H 13/0043 |
| 2020/0108925 | A1 * | 4/2020 | Smith | B64D 1/08 |

(Continued)

OTHER PUBLICATIONS

International Search Report and Written Opinion for International Application No. PCT/US2022/20755, dated Jan. 19, 2023.

*Primary Examiner* — Samir Abdosh
(74) *Attorney, Agent, or Firm* — Leydig, Voit & Mayer, Ltd.

(57) ABSTRACT

A system for disabling or destroying an unmanned aerial vehicle (UAV) is provided. The system comprises an anti-UAV system and an anti-UAV computing platform. The anti-UAV system comprises: a plurality of laser devices configured to generate a plurality of laser beams at a plurality of different wavelengths; a coarse wavelength division multiplexing (CWDM) combiner configured to combine the plurality of laser beams from the plurality of laser devices into a combined laser beam; and a tracking device configured to detect a UAV. The anti-UAV computing platform is configured to: detect, using the tracking device, an object within range of the tracking device; and based on detecting the object, direct, using the anti-UAV system, the combined laser beam from the CWDM combiner onto the detected object.

20 Claims, 10 Drawing Sheets

700

(56) References Cited

U.S. PATENT DOCUMENTS

| | | | | |
|---|---|---|---|---|
| 2022/0412700 | A1* | 12/2022 | Sipes, Jr. | F41H 13/005 |
| 2023/0016800 | A1* | 1/2023 | Nugent, Jr. | H02J 50/005 |
| 2023/0099600 | A1* | 3/2023 | Blate | F41H 13/005<br>250/493.1 |
| 2023/0194218 | A1* | 6/2023 | Nugent, Jr. | F41H 13/0068<br>342/13 |

* cited by examiner

700

800

900

1000

COMPACT LASER SYSTEM FOR DIRECTED ENERGY APPLICATIONS

CROSS-REFERENCE TO RELATED APPLICATIONS

This patent application is a continuation of U.S. application Ser. No. 17/697,085, filed on Mar. 17, 2022, which claims priority to U.S. Provisional Patent Application No. 63/162,651, filed Mar. 18, 2021, the entire contents of each of these applications being hereby incorporated by reference herein in its entirety.

BACKGROUND

Unmanned Aerial Vehicles (UAVs) or Drones provide opportunities for mal-intentioned groups for spying on or attacking individuals, groups and/or facilities. Both military and commercial organizations have expressed interest in countering these vehicles through either blinding their sensors, disrupting their communications, or completely disabling their operations. Laser based systems are under consideration for such anti-UAV countermeasures.

SUMMARY

This summary is provided to introduce certain exemplary embodiments that are further described below. This summary is not intended to be an identification of key features or essential features of the present disclosure.

In an embodiment, the present disclosure provides a system for disabling or destroying an unmanned aerial vehicle (UAV), comprising: an anti-UAV system comprising: a plurality of laser devices configured to generate a plurality of laser beams at a plurality of different wavelengths; a coarse wavelength division multiplexing (CWDM) combiner configured to combine the plurality of laser beams from the plurality of laser devices into a combined laser beam; and a tracking device configured to detect a UAV. The system further comprises an anti-UAV computing platform configured to: detect, using the tracking device, an object within range of the tracking device; and based on detecting the object, direct, using the anti-UAV system, the combined laser beam from the CWDM combiner onto the detected object.

In some variations, the tracking device is a capturing device that is configured to detect a reflection of the combined laser beam output by the CWDM combiner, the anti-UAV computing platform is further configured to: output, using the anti-UAV system, the combined laser beam at a first scan angle, detecting the object within the range of the tracking device comprises detecting the object within the first scan angle of the combined laser beam based on the reflection of the combined laser beam on the object, and directing the combined laser beam onto the detected object comprises converging the combined laser beam onto the detected object by reducing the first scan angle.

In some instances, the CWDM combiner comprises a plurality of thin film filters. The plurality of thin film filters comprises: a first thin film filter configured to combine a first laser beam from a first laser device, of the plurality of laser devices, with a second laser beam from a second laser device, of the plurality of laser devices, to generate a first combined laser beam; and a second thin film filter configured to combine the first combined laser beam with a third laser beam from a third laser device, of the plurality of laser devices, to generate a second combined laser beam, wherein the combined laser beam is based on the second combined laser beam.

In some examples, the plurality of thin film filters comprises: a third thin film filter configured to combine the second combined laser beam with a fourth laser beam from a fourth laser device, of the plurality of laser devices, to generate a third combined laser beam; and a fourth thin film filter configured to combine the third combined laser beam with a fifth laser beam from a fifth laser device, of the plurality of laser devices, to generate a fourth combined laser beam, wherein the combined laser beam is the fourth combined laser beam.

In some variations, each of the plurality of laser devices comprises a Ytterbium (Yb) laser medium.

In some instances, each of the plurality of laser devices comprises an Erbium (Er) laser medium or a Thulium (Tm) laser medium In some examples, the plurality of different wavelengths of the plurality of laser devices are within a wavelength window, and detecting the object within the first scan angle is based on using a filter associated with the wavelength window to filter out pixels outside of the wavelength window.

In some variations, the CWDM combiner comprises a beam expander configured to converge or diverge the combined laser beam, and the anti-UAV computing platform is configured to output the combined laser beam at the first scan angle by directing the beam expander to diverge the combined laser beam to the first scan angle.

In some instances, the anti-UAV computing platform is configured to converge the combined laser beam onto the detected object by: causing the beam expander to direct additional laser power onto the detected object based on reducing a scan angle of the combined laser beam from the first scan angle.

In some examples, the anti-UAV system further comprises: a movable beam director platform configured for elevation adjustment and azimuth adjustment, wherein the anti-UAV computing platform is further configured to converge the combined laser beam onto the detected object by: adjusting an elevation or an azimuth angle of the movable beam director platform.

In some variations, the anti-UAV computing platform is configured to detect the object based on receiving an image from the capturing device indicating the object, and the adjusting the elevation or the azimuth angle of the movable beam director platform is based on the image from the capturing device.

In some instances, the movable beam director platform comprises: the capturing device; and a two-axis scan head configured to direct the combined laser beam.

In some examples, the tracking device is a laser device that is separate from the plurality of laser devices.

In some variations, a laser device of the plurality of laser devices comprises a ring laser oscillator, wherein the ring laser oscillator comprises a wavelength division multiplexed (WDM) combiner, an adjustable tap coupler, a first gain fiber, and a circulator.

In some instances, the laser device further comprises a second gain fiber configured to output a fiber signal and coupled to an output of the ring laser oscillator, a plurality of laser diodes configured to provide pump light, and a signal combiner configured to generate an output based on the pump light and the fiber signal from the second gain fiber.

In another embodiment, the present disclosure provides a method for disabling or destroying an unmanned aerial vehicle (UAV), comprising: generating, by an anti-UAV system, a plurality of laser beams at a plurality of different wavelengths; combining, by the anti-UAV system, the plurality of laser beams from the plurality of laser devices into a combined laser beam; detecting, by the anti-UAV system, an object within range of a tracking device of the anti-UAV system; and based on detecting the object, directing, by the anti-UAV system, the combined laser beam from the CWDM combiner onto the detected object.

In some instances, generating the plurality of laser beams comprises generating, by a plurality of laser devices, the plurality of laser beams at the plurality of different wavelengths, wherein each of the plurality of laser devices comprises a Ytterbium (Yb) laser medium.

In some examples, generating the plurality of laser beams comprises generating, by a plurality of laser devices, the plurality of laser beams at the plurality of different wavelengths, wherein each of the plurality of laser devices comprises an Erbium (Er) laser medium or a Thulium (Tm) laser medium.

In some variations, the tracking device is a capturing device, wherein the method further comprises: outputting, using the anti-UAV system, the combined laser beam at a first scan angle, wherein detecting the object within the range of the tracking device comprises detecting the object within the first scan angle of the combined laser beam based on a reflection of the combined laser beam on the object, and wherein directing the combined laser beam onto the detected object comprises converging the combined laser beam onto the detected object by reducing the first scan angle.

In yet another embodiment, the present disclosure provides an anti-unmanned aerial vehicle (UAV) system for disabling or destroying a UAV, comprising: a plurality of laser devices configured to generate a plurality of laser beams at a plurality of different wavelengths; a coarse wavelength division multiplexing (CWDM) combiner configured to combine the plurality of laser beams from the plurality of laser devices into a combined laser beam; and a capturing device configured to: provide instructions to output the combined laser beam at a first scan angle; detect an object within the first scan angle of the combined laser beam based on a reflection of the combined laser beam; and based on detecting the object, provide instructions to the CWDM combiner to converge the combined laser beam onto the detected object by reducing the first scan angle.

Further features and aspects are described in additional detail below with reference to the figures.

DETAILED DESCRIPTION

Laser-based directed energy (DE) weapons have been under development for several decades. Early lasers were megawatt-class chemical lasers, then bulk solid-state electric lasers, followed ultimately by combined fiber lasers. Currently, fiber lasers are becoming a more popular type of laser and are moving toward deployment as they are efficient, rugged, and of very low size, weight, and power (SWAP), which allows them to be mounted on an array of platforms including land, sea, air, and even space based.

While the small signal propagating core size of a typical fiber laser (about 20 micrometers (μm)) allows for very long fiber lasers with wide heat distribution in a diameter of about 6 inches, this small core size limits the typical fiber laser output to around 2-3 kiloWatts (kW) of output power. For common laser engagement and disruption scenarios (e.g., disabling incoming missiles, shells, and planes) at over 10 kilometers (km), power levels in the 100 kW to 300 kW are typically required. These limitations may be overcome through the use of fiber laser combining techniques such as spectral beam combining (SBC) where multiple fiber laser channels each operate at a different wavelength and are combined together through a ruled grating or through coherent beam combining (CBC) where a single narrow linewidth source is split a number of ways and each output is amplified and then combined together in either the far-field through diffraction (tiling), or by way of mirrors or other diffraction optical elements. The principle for CBC laser systems is similar to optical interferometers such as the Michelson interferometer. An example of a coherently combined laser system (e.g., a traditional CBC laser system) is shown in FIG. 1.

Figure 1:
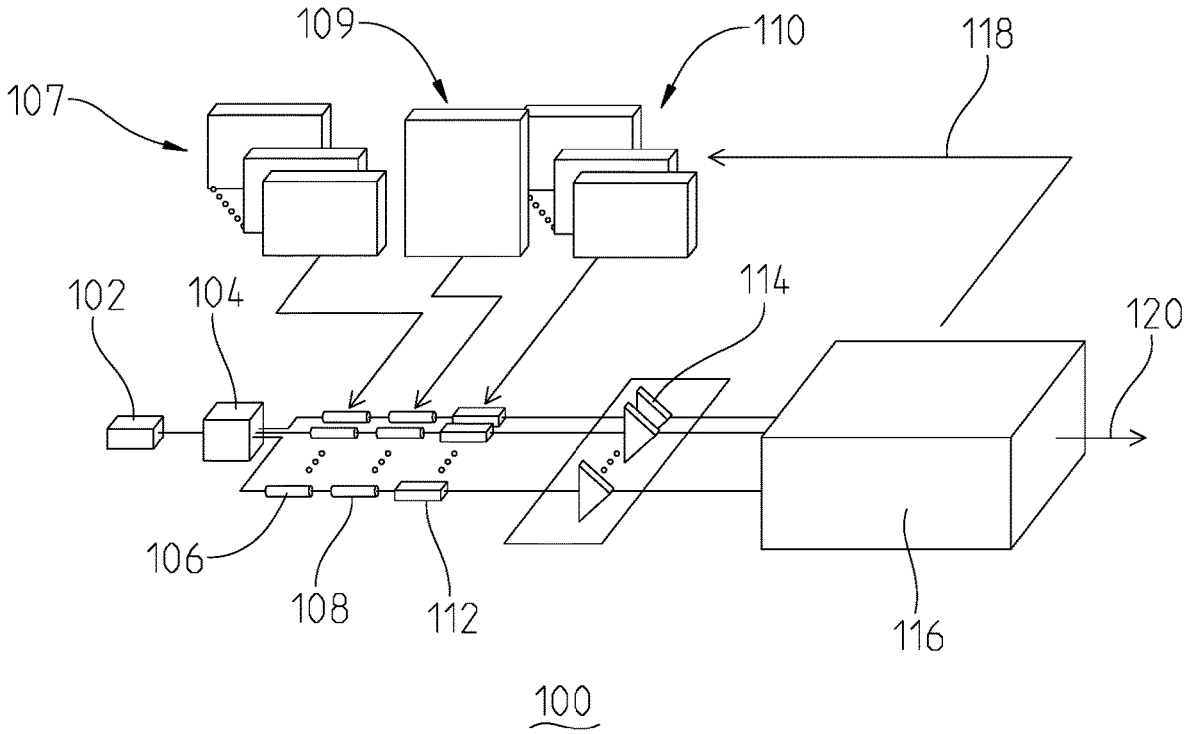
FIG. 1 Prior Art
FIG. 1 shows a coherently combined laser system.

For example, FIG. 1 shows a CBC laser system 100 that includes a seed laser 102 that outputs a laser beam and a splitter 104 (1:N Splitter) that splits the laser beam into a plurality of beams (e.g., an N number of beams). The CBC laser system 100 further includes a phase (piston) actuator 106 and a radio frequency (RF) phase modulator 108 for direct (DC) phase bias 107 and/or for performing saw-tooth modulations. The RF phase modulator 108 may further include pseudo-random bit stream (PRBS) devices and a dither generator 109 that perform digitally delayed PRBS and dithering techniques. The CBC system 100 also includes polarization controller 112 that performs polarization control 110. The CBC system 100 additional includes amplifiers 114 that amplify the laser beams from the splitter 104 and a beam combiner 116 that combines the beams from the amplifiers 114 and outputs an output laser beam 120. The beam combiner 116 further provides optical feedback 118 to the polarization control 110/the polarization controller 112.

In some instances, the phase modulator 108 may be used for phase locking the lasers together via a LOCKSET method. A PRBS phase modulation code, used by the PRBS devices of the modulator 108, may be added to spread the spectrum to increase the threshold to fiber non-linearities such as Stimulated Brillouin Scattering (SBC).

Figure 2:
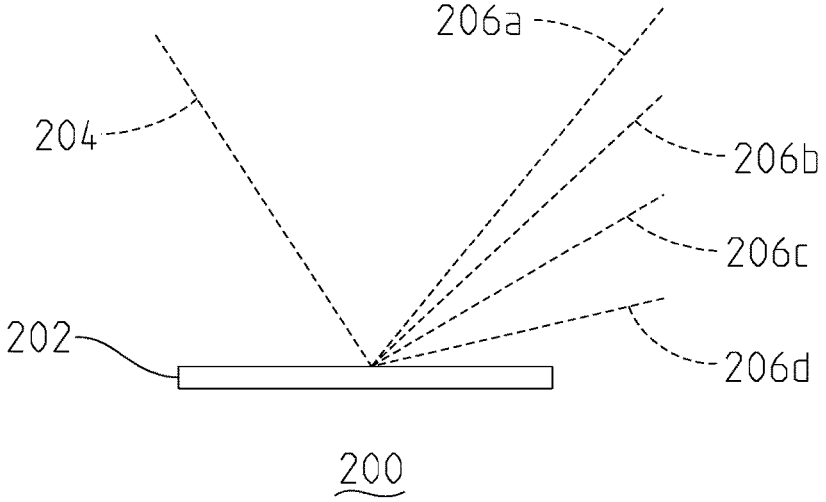
FIG. 2 Prior Art
FIG. 2 shows utilizing a diffraction grating for separating a laser beam into a plurality of wavelengths.

FIG. 2 shows utilizing a diffraction grating for separating a laser beam into a plurality of wavelengths. In particular, as shown, a diffraction grating 202 is shown that separates a source 204 (e.g., a laser source) into a plurality of wavelengths of light **206*a*-206*d*. Each of the wavelengths of light 206*a*-206*d* may be of a different wavelength. For instance, the use of the diffraction grating causes angle deflection of a light source or laser source. In laser combining, this principle is operated in reverse, which leads to spectral beam combining (SBC). For instance, the properties of the grating 202 are adjusted so that the outputs of multiple fiber lasers (e.g., 206*a*-206*d*) may be combined into a single beam (e.g., the beam 204**) that is output.

However, a problem with this approach is that within each laser wavelength channel, the actual linewidth of each channel is also angularly disbursed. In other words, the laser linewidth translates into a lateral spread of the beam, causing a reduction in beam quality.

In some instances, the wavelength creates angular dispersion. The combination or splitting of the beams uses the angular dispersion to split or combine the beams, and may be linear. In the combining case, the angular dispersion is in one dimension so a finite linewidth of the laser may be dispersed over a range of angles depending on the linewidth. Therefore, a broader linewidth after going through the grating may result in an oval beam with a loss of beam quality in the dispersion direction.

In these SBC systems, the desire is to keep the beam quality of the system as close to the diffraction limit as possible as defined by the wavelength divided by the final diameter of the beam. The diffraction limit represents the minimal optics needed to expand the beam to have sufficient power intensity to do damage to the UAV for a given power.

Because of this problem, in grating-based SBC systems, the linewidth of the laser is kept to fractions of a nanometer. This constraint limits the power per channel that may be achieved due to Stimulated Brillioun Scattering (SBS), which is a fiber non-linearity that disrupts laser operation. A typical grating-based SBC directed energy (DE) system has channels that are 5 to 20 giga-Hertz (GHz). This limits the per-channel output to about 2 kW in a spectrally precisely aligned SBC system. The advantage of this approach is that large number of channels can be closely spaced for higher powers. Existing grating-based SBC systems have been demonstrated in the 60 kW to 100 kW range. In order to achieve these narrow linewidths, a Master Oscillator/Power Amplifier (MOPA) structure is employed in such systems.

Therefore, while conventional SBC and CBC lasers systems are scalable to hundreds of kW with near diffraction limited beam quality, they are very complex and costly. Further, it may be difficult to have all components working adequately at the same time. Additionally, many control loops are required to control the path length, phase, and polarization in order to get efficient beam combining. While SBC systems are simpler than CBC approaches, the close proximity of the large number of laser channels requires precise spectral alignment of spectrally narrow channels. Both of these approaches require MOPA configurations where a low power laser, typically a laser diode, is amplified through about 60 decibels (dB) of total gain through multiple amplifier stages that are typically around 20 dB of gain in each stage. As a result, these systems are expensive to build and manage.

Anti-UAV applications (e.g., as by blinding their sensors, disrupting their communications, and/or completely disabling their operations) typically involve relatively close ranges, such as less than 50 meters (m), and generally under 1 kW of power. These closer ranges, as well as for smaller and slower-moving UAVs, allows for a lower power level to be used. For example, power at around the 20 kW to 30 kW level may be adequate to disable a UAV at around 4 km using a 5 to 20 second dwell time (e.g., a time the laser is directed onto the UAV). The distributed nature of the UAV threat, however, means that a large number of the anti-UAV laser systems may need to be placed around a military encampment or a critical facility. This in turn means that these laser systems should be of relatively low cost, complexity, and of moderate to low SWAP. Current MOPA-based SBC and CBC approaches are too complex and expensive to be utilized widely in anti-UAV applications.

Embodiments of the present disclosure provide an anti-UAV laser system usable for directed energy applications including blinding UAV sensors, disrupting UAV communications, or completely disabling UAV operations. Among other advantages, the anti-UAV laser system may achieve a very large reduction in complexity, SWAP, and cost relative to existing approaches such as SBC and CBC approaches. In particular, exemplary embodiments of the present disclosure utilize an SBC approach with coarse wavelength division multiplexing (CWDM). For example, in some instances, by using the anti-UAV laser system of the present disclosure, the present disclosure allows for more channels to be placed closer together in wavelength to make the lasers operate at a narrower linewidth. Further, the present disclosure may use Dichroic mirrors (e.g., a flat, sharp edged filter where any light on one side of the edge is passed and light on the other side of the edge is reflected). As such, this may free the laser design from constraining the laser linewidth to a minimum, which greatly reduces the cost for manufacturing such a laser system.

Figure 3:
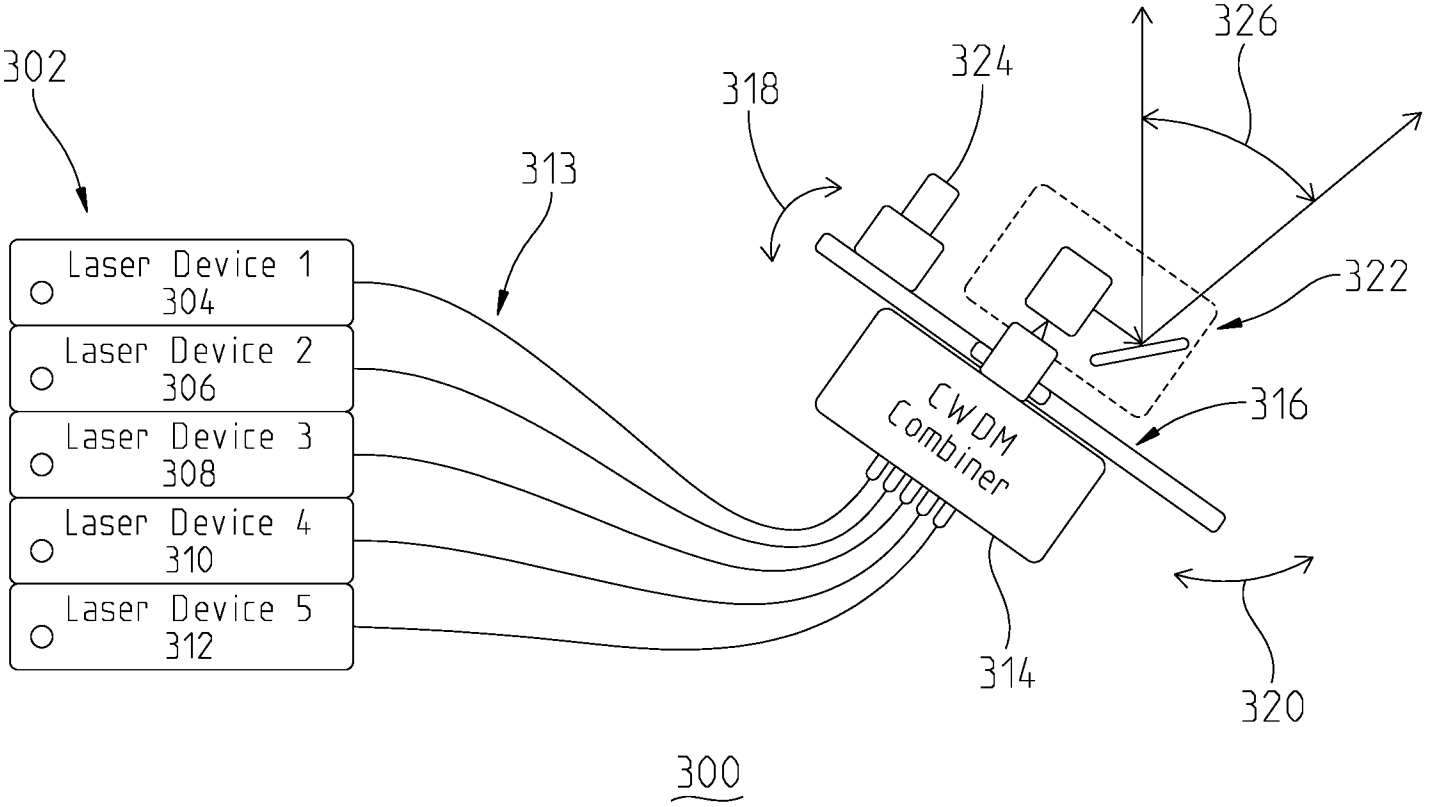
FIG. 3 shows an exemplary anti-UAV laser system for a directed energy application according to one or more examples of the present application.

FIG. 3 shows an exemplary anti-UAV laser system 300 for a directed energy application according to one or more examples of the present application. The anti-UAV laser system 300 includes a laser stack 302 that includes multiple laser devices (e.g., five laser devices 304-312 or laser channels). Each laser channel/device 304-312 may output a different wavelength laser beam. In some instances, the laser stack 302 may be a 20 kW to 30 kW laser stack and includes five channels or lasers beams. The laser devices 304-312 may be coupled to a CWDM combiner 314 via input fibers 313. The input fibers 313 may be input fiber connectors with collimators. In some examples, the laser stack 302 may include a different number of channels or laser beams and may output a different power rating. Each of the devices 304-312 is input into a CWDM combiner 314 via the input fibers 313. The CWDM combiner 314 is a wavelength division multiplexer that may combine multiple signals at various wavelengths (e.g., the laser beams from the channels of the laser stack 302) into a single, combined signal (e.g., a single, combined laser beam). The CWDM combiner 314 includes a beam expander that may increase the input laser beam and/or set the divergence of the laser beam. For example, the CWDM combiner 314 may be and/or include a device that uses wavelength separation channels that are spaced apart (e.g., over 2 nm apart such as 5 to 10 nm apart). In some instances, each laser device/channel 304-312 may operate at 3.5 kW (e.g., provide a laser beam that is at 3.5 kW). Then, the CWDM combiner 312 combines these 3.5 kW laser beams into a single beam. The single beam from the CWDM combiner 312 may be capable of shooting down a drone or UAV at around 4 kilometers (km).

The CWDM combiner 314 is part of a movable beam director platform 316 with elevation adjustment 318 that adjusts a height of the platform 316 and azimuth adjustment 320 that adjusts an angle of the platform 316. The movable beam director platform 316 further includes a two-axis scan head 322 and a capturing device 324. The two-axis scan head 322 is configured to direct, re-direct, and/or steer the laser beam output from the CWDM combiner 314. The capturing device 324 may be a wide angle device such as a wide angle camera and may be configured to scan for and/or detect an object such as a UAV. For instance, the capturing device 324 may be used with the two-axis scan head 322 to detect the object (e.g., an 4 inch output beam for detecting the object and/or for disabling/destroying the UAV). In some instances, the CWDM combiner 314 and the two-axis scan head 322 may be used together to adjust a scan angle 326 of the laser beam. For instance, the CWDM combiner 314 (e.g., the beam expander within the CWDM combiner 314) may be used to expand or diverge the laser beam by adjusting the scan angle 326 (e.g., the smaller the scan angle 326, the less divergence the laser beam has). For example, the CWDM combiner 314 may take a 10 millimeter (mm) to a 100 mm beam and reduce the beams divergence (e.g., by a factor of 10). The two-axis scan head 322 may be used to steer the laser beam (e.g., direct the laser beam using elevation and/or azimuth adjustments 318, 320) to an intended location (e.g., towards an object detected by the capturing device 324). In some examples, the two-axis scan head 322 may steer the laser beam without expanding or contracting the laser beam.

Each of the fiber laser devices 304-312 corresponds to a respective fiber laser device/channel that is connected to a common system manager (e.g., a system with one or more processors and/or memory), for example, via Ethernet, military-grade communications, wireless communication protocols (e.g., WI-FI or BLUTOOTH), or other types of communication methods. A computing platform such as a software computing platform with one or more processors and/or memory may be used to control the system features and/or interface with higher level system functions. For example, the computing platform may include one or more computing devices such as a common system manager for the fiber laser devices 304-312. The computing platform may be a dedicated computing platform for anti-UAV applications and may interface with higher level system functions. Additionally, and/or alternatively, the computing platform may be part of another computing platform or system configured to perform other functionalities or applications.

In operation, the computing platform may be configured to perform anti-UAV applications such as blind UAV sensors, disrupt UAV communications, or completely disable UAV operations. For example, the computing platform may be configured to provide instructions to the laser stack 302 for the channels/devices 304-312 of the laser stack 302 to produce a plurality of laser beams. The CWDM combiner 314 obtains the plurality of laser beams and combines the laser beams into a single, combined laser beam. Furthermore, the CWDM combiner 314 includes a beam expander that may set the beam size to a desired beam divergence. The beam director platform 316 and the two-axis scan head 322 may be used to direct the combined laser beam from the CWDM combiner 314. For example, using the two-axis scan head 322 and/or the elevation adjustment 318 and azimuth adjustment 320 of the beam director platform 316, the movable beam director platform 316 directs the laser beam onto a certain direction. For instance, initially, as shown in FIG. 3, the movable beam director platform 316, using the scan head 322, directs the laser beam into a scan range to scan for an object such as a UAV. The capturing device 324 may be used to view the region scanned by the laser (e.g., view the laser beam within the scan range) and provide feedback (e.g., images or videos) to the computing platform.

The computing platform, based on the feedback, may determine whether a UAV is detected. For example, the 2-axis scan head 322 provides the laser beam using a raster or other pattern type in the general region of the suspected target. The capturing device 324 may capture an image of the region such as by filtering the region to between wavelengths provided by the laser beam (e.g., within the 1025 nanometer (nm) to 1080 nm window). In other words, the capturing device 324 captures images or videos over the region scanned by the laser beam for a reflection from the laser beam. The capturing device 324 provides the data such as the captured images or videos of the scanned region to the computing platform. Additionally, and/or alternatively, the capturing device 324 provides elevation and azimuthal information of the beam director platform 316 to the computing platform. Based on the images or videos from the capturing device 324, the computing platform may provide instructions to the 2-axis scan head 322, actuating devices (e.g., motors such as servo motors), and/or the CWDM combiner 314 to re-adjust the beam director platform 316 and/or converge the laser beam. To put it another way, the computing platform may provide instructions to adjust the elevation and/or azimuth of the beam director platform 316 (e.g., by using the 2-axis scan head 322 to direct or steer the laser beam). Furthermore, the computing platform may reduce the width of the laser beam output from the CWDM combiner 314 (e.g., by using a beam expander of the CWDM combiner 314 to converge the laser beam such as by reducing the scan angle 326 of the output laser beam). The computing platform may continuously adjust the elevation and/or azimuth of the beam director platform 316 and/or reduce the width of the laser beam (e.g., converge the laser beam by reducing the scan angle 326) such that after one or more iterations, the full laser power of the laser beam output from the CWDM combiner 314 is engaged on the target (e.g., the detected UAV) and the target is disabled and/or destroyed.

Each fiber laser device (e.g., fiber laser module/channel) 304-312 may have a respective fiber optic cable output therefrom which includes a fiber laser gain fiber. The length of the connection from the fiber laser stack 302 to the beam director platform 316 may be, for example, on the order of 10 m. However, 10 m is merely exemplary and the length of the connections may be a different length. This distance is set based on the onset of SBS non-linearities determined by the fiber length and the chosen lasing linewidth. In some instances a passive single mode Large Mode Area fiber may replace one or more of the fiber laser gain fibers.

Figure 5:
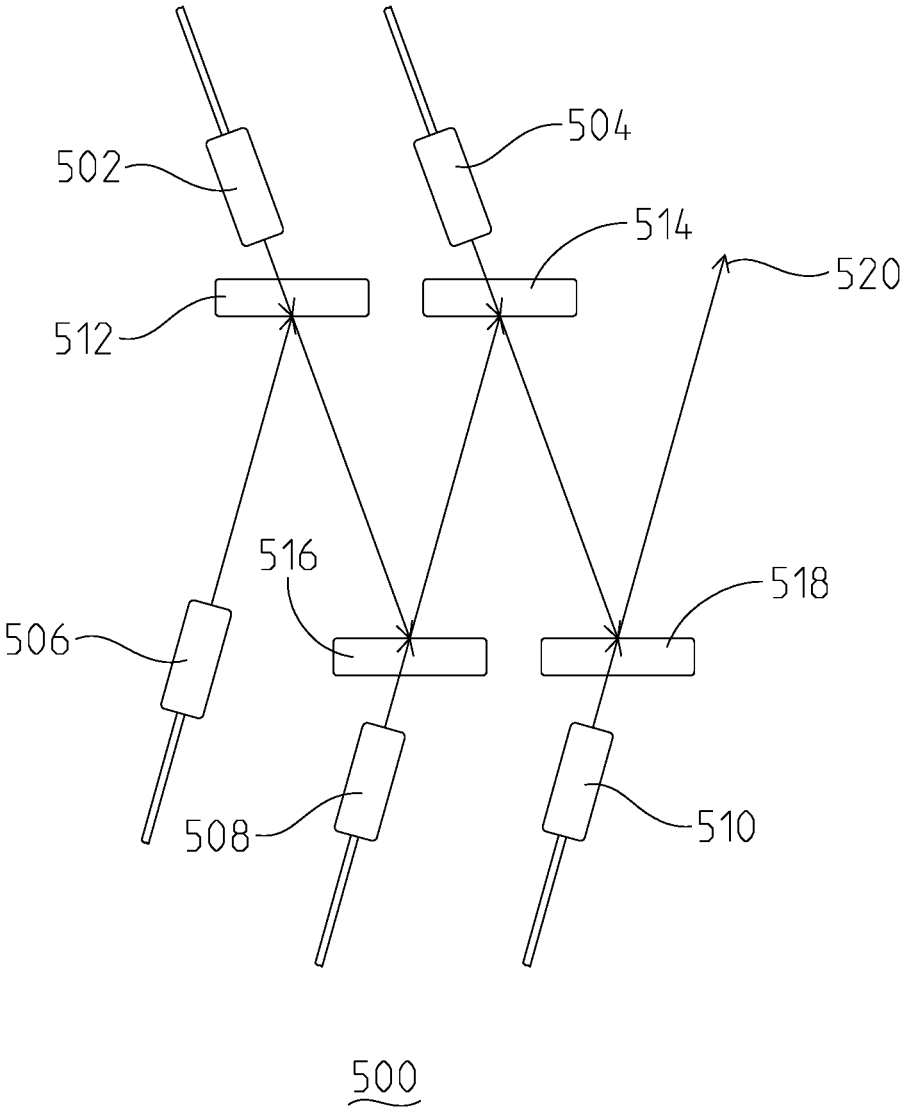
FIG. 5 shows a laser combination setup of the anti-UAV laser system according to one or more examples of the present application.

The beam director platform 316 shown in the right side of FIG. 3 includes a plate that is adjustable in the azimuthal and elevation directions to provide a solid angle visibility of at least pi steradians. The fibers or connections from each fiber laser device 304-312 (e.g., the fiber laser modules) interface with the beam director platform 316 via the CWDM 314. In some instances, the CWDM 314 may include and/or be connected to a fiber connector with an embedded collimator. These fibers connect into a coarse wavelength multiplexer of the CWDM 314, for example, as shown in FIG. 5, which will be discussed below. After the beams from the fibers of the fiber laser devices 304-312 are combined, the beams are transferred to the front surface of the beam director platform 316 through a beam expander that sets the beam size to a desired beam divergence or convergence. Mounted on the front surface of the beam director platform 316 is a two-axis scanning system (e.g., the 2-axis scan head 322). In some instances, the two-axis scanning system (e.g., the 2-axis scan head 322) may include two mirrors mounted where they each rotate about axes that are perpendicular to each other. In some instances, the scanning mirrors of the 2-axis scan head 322 may be of the galvanometer type (e.g., a galvanometer scanning mirror). In other instances, other types of scanning mirrors may be used. The use of these two scanning mirrors provides for the ability to access a solid angle at any point in the scan.

In some instances, systems may detect a target UAV through various detection mechanisms, including but not limited to, for example, light detection and ranging (LIDAR) or radio detection and ranging (RADAR) detection. Additionally or alternatively, in some examples, systems (e.g., DE systems) may use a tracking illumination laser (TILL) or a beacon illumination laser (BILL) to target a UAV, followed by a directed energy high energy laser (DE-HEL) being used to disable it. For example, in some embodiments of the present disclosure, a tracking device (e.g., LIDAR, RADAR, and/or a tracking/beacon laser) may be used with the CWDM combiner 314 to disable or destroy a UAV. For instance, the tracking device (e.g., a laser device that is separate from the laser devices 304-312) may detect the UAV and provide information indicating the detected UAV to a computing entity such as a computing platform. Based on detecting the UAV, the plurality of laser devices 304-312 may generate a plurality of laser beams. The CWDM combiner 314 may combine the laser beams and direct the combined laser beam towards the detected UAV (e.g., by using a beam expander, a telescope device, and/or a scanning mirror) to disable or destroy the UAV.

However, in other embodiments, the present disclosure may use a system with solely a DE-HEL (e.g., a system without a LIDAR, RADAR, BILL, or TILL system/device for tracking the UAV). To put it another way, as described above, the anti-UAV laser system 300 may use the laser system/beam to both track and disable or destroy the UAV. For instance, after an object (e.g., a UAV) has been identified, the single DE-HEL engages the target at a reduced power level. The fast scanning mirrors (e.g., the 2-axis scan head 322) uses the laser in a raster or other pattern to scan the general region of the suspected target/object. The capturing device 324 captures images of the region scanned by the laser and filters the images using a 1025 nm to 1080 nm window so as to scan for a reflection from the laser beam output by the CWDM combiner 314. Once acquired (e.g., after detecting the UAV), the capturing device 324 may provide elevation and azimuthal information to the beam director platform 316, and smaller and smaller scan regions are progressively scanned until sufficiently small such that the full laser power is engaged and the target (e.g., the UAV) is disabled or destroyed.

To put it another way, the present disclosure uses a tracking device to track and/or detect a UAV and direct the output from the CWDM combiner 314 towards the detected UAV. In some instances, the tracking device is a separate laser device, a LIDAR, and/or a RADAR that is used to track the UAV and provide information indicating the location of the detected UAV to a computing platform. In other instances, the tracking device is a capturing device such as capturing device 324, and the combined output from the CWDM combiner 314 is used to track and disable/destroy the UAV. For instance, initially, the anti-UAV system 300 may output a combined laser beam at a first scan angle. The capturing device 324 may detect a reflection of the combined laser beam output by the CWDM combiner 314, and provide information indicating the reflection associated with a UAV to a computing platform. The computing platform may use the information to converge the combined laser beam output from the CWDM combiner 314 onto the detected UAV so as to disable/destroy the UAV. This will be described in further detail below.

Figure 4:
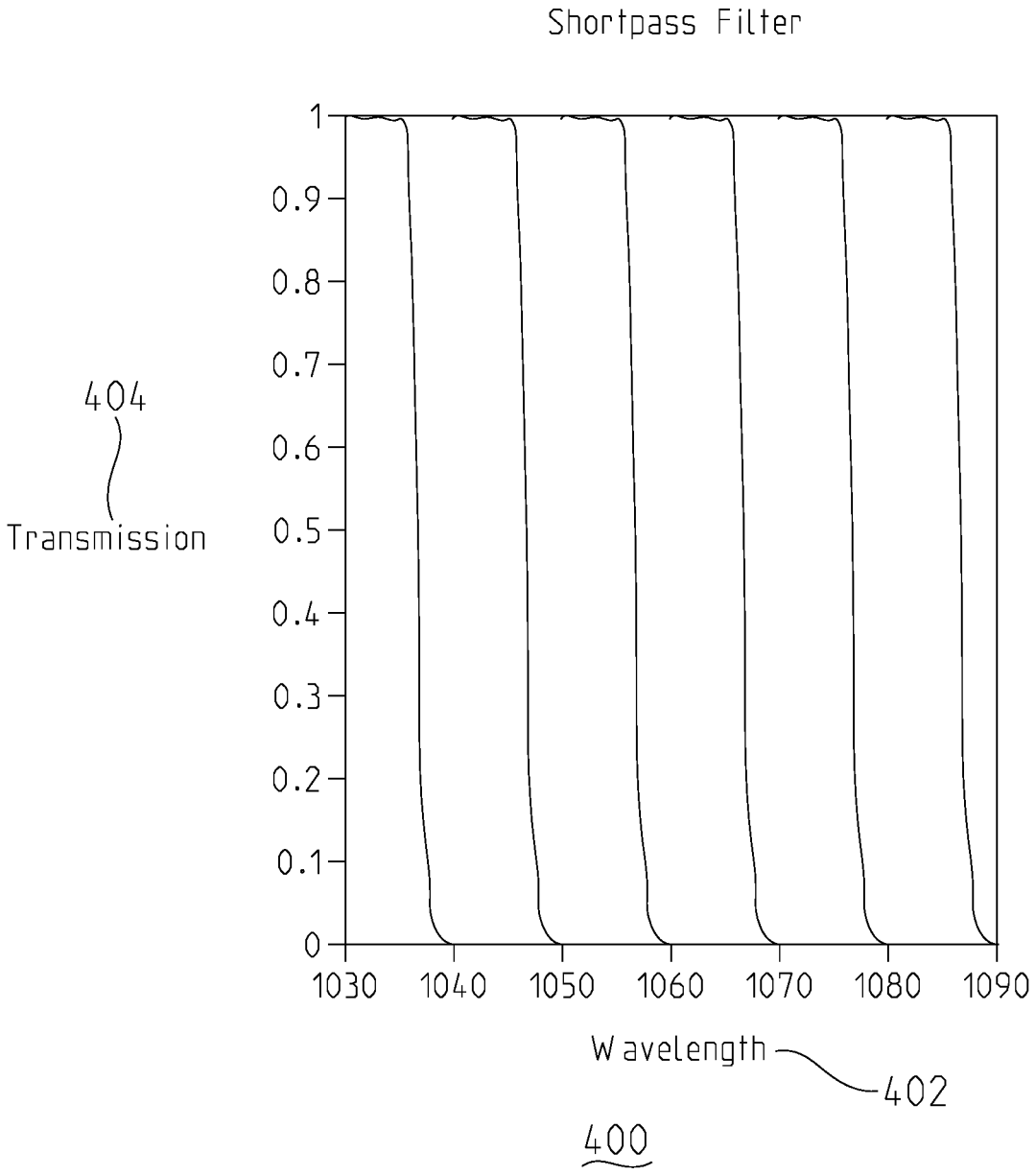
FIG. 4 shows a graphical representation of a mirror filter cutoff spectra as a function of angle according to one or more examples of the present application.

In some instances, a 1025 nm to 1080 nm lasing band of Ytterbium (Yb) in glass fiber may be used as the laser medium for the laser devices 304-312. In other instances, the laser devices 304-314 may include an Erbium (Er) lasing band around 1550 nm and/or the Thulium (Tm) lasing band around 2000 μm, which may be subdivided into 5 nm and 10 nm sections. Individual fiber lasers of the laser devices 304-312 may operate spectrally in the middle of these bands, and then each of the individual fiber lasers may be combined by way of thin film mirror filters, which are shown in FIG. 5. An example of a typical passband of a thin film filter (e.g., thin-film optical filters) as a function of incident angle is illustrated in FIG. 4. In some instances, the film filters in the system 330 may be from a number of commercial suppliers and have very sharp cutoffs, and the film filters may be made of large apertures to lower the power intensity for multi-kW operations.

For instance, FIG. 4 shows a graphical representation 400 of a mirror filter cutoff spectra as a function of angle according to one or more examples of the present application. For instance, the graphical representation 400 shows the transmission of different wavelengths of a Shortpass Filter. The x-axis shows the wavelengths 402 and the y-axis shows the transmissions 404. For example, the anti-UAV laser system 300 may include a plurality of filters such as the Shortpass filters. The filter may have the profile shown in the graphical representation 400. For instance, the filters may have sharp cutoffs (e.g., transmission at 0) at particular wavelengths such as wavelengths 1040-1090. In other words, the anti-UAV laser system 300 may include different filters at different cutoffs so as to be able to combine laser beams from different laser devices 304-312 at different wavelengths.

In the Yb embodiment, the Yb lasing band may be subdivided into 10 nm windows for 5 operating bands beginning at 1025 nm, with the lasering operations of 5 individual fiber lasers centered at 1030 nm, 1040 nm, 1050 nm, 1060 nm, and 1070 nm, respectively. Each laser is configured to operate with a 2-4 nm linewidth such that there is a sufficient passband between the laser linewidth and the filter cutoff for efficient combining. A technique for combining multiple lasers utilizing these thin film mirrors is illustrated in FIG. 5. FIG. 5 shows a laser combination setup 500 of the anti-UAV laser system according to one or more examples of the present application. For example, FIG. 5 shows the CWDM combiner 314 or a part of the CWDM combiner 314 (e.g., the part of the CWDM combiner 314 prior to the beam expander device). In particular, the output from the fibers of the five laser devices 304-312 (e.g., from the five separate channels of the laser stack 302) are shown as 502-510. For instance, the laser device output 502 may be an output from the second laser device 306 (e.g., a 1040 nm laser beam delivered by the second laser device 306). The laser device output 504 may be an output from the fourth laser device 310 (e.g., a 1060 nm laser beam). The laser device output 506 may be an output from the first laser device 304 (e.g., a 1030 nm laser beam). The laser device output 508 may be an output from the third laser device 308 (e.g., a 1050 nm laser beam). The laser device output 510 may be an output from the fifth laser device 312 (e.g., a 1070 nm laser beam). Additionally, four thin film filters 512-518 are used to combine the laser beams from the laser devices 304-312 into a single laser beam 520 that may be output by the CWDM combiner 314. The four thin film filters 512-518 may be long wavelength pass/short wavelength reflect filter mirrors. For example, the first output 502 may be associated with the first laser device 304 and output a laser beam at a first wavelength (e.g., 1030 nm). The second output 504 may be associated with the second laser device 306 and output a laser beam at a second, different wavelength (e.g., 1040 nm). Similarly, the third, fourth and fifth outputs 506-510 may be associated with laser devices 308-312 and output laser beams at multiple different wavelengths (e.g., 1050 nm, 1060 nm, and 1070 nm). Each of the thin film filters 512-518 may combine the previous laser beam with another laser beam from another output (e.g., thin film filter 512 combines the laser beam from the first output 502 with the laser beam from the second output 504). The film filter 518 combines all five laser beams from the five outputs 502-510 to produce a combined laser beam 520 that is output.

To put it another way, there are five fiber laser devices 302-312 that each outputs a laser at one of the five wavelengths. Each of the five lasers is directed to a respective thin film long wavelength pass and short wavelength reflect filter mirror, and the end result is a laser output that combines all five lasers into one laser channel output. In some examples, the anti-UAV system 300 may use six laser beams rather than five laser beams with different wavelengths (e.g., 1045 nm, 1050 nm, 1060 nm, 1070 nm, 1080 nm, and 1090 nm) to detect the UAV and/or disable/destroy the UAV. For instance, the anti-UAV system may combine the six laser beams using five film filters into a combined laser beam and use the combined laser beam for anti-UAV applications.

In some instances, the thin film system of the present disclosure (e.g., the film filters 512-518) does not suffer from the linewidth to beam quality degradation problem of the SBC and CBC lasers systems because of the sharp cutoff of the filters 512-518. This allows for the linewidth to increase to 1-3 nm, thus allowing for higher output power per laser (e.g., from 2 kW in the grating case in a conventional system to 4-6 kW in the CWDM case according to examples of the present disclosure). Higher power-per-channel allows for fewer channels for lower overall dollar/watt of output costs. Additionally, the thin film CWDM approach according to embodiments of the present disclosure allows for fiber laser oscillators to be used instead of expensive and complex MOPA structures.

Figure 6:
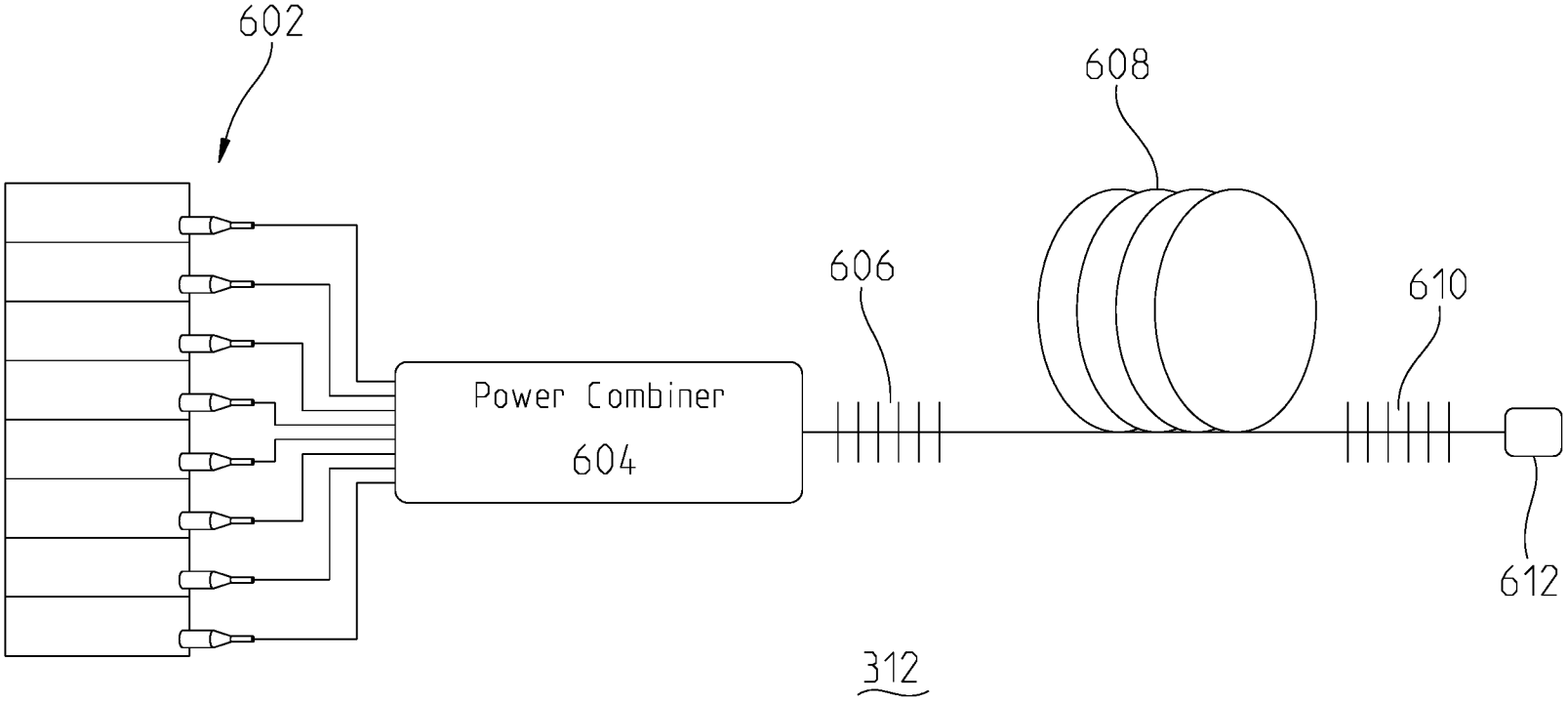
FIG. 6 shows an example of an individual fiber laser module of the anti-UAV laser system according to one or more examples of the present application.

FIG. 6 shows an example of an individual fiber laser device (e.g., fiber laser module) of the anti-UAV laser system according to one or more examples of the present application. For instance, FIG. 6 shows a laser device such as laser devices 304-312 of FIG. 3. The individual fiber laser may be, for example, a 5 kW, 3 nm linewidth fiber laser. The laser device includes a plurality of output fibers 602. The output fibers 602 may be 220/240 micrometer, 0.22 numerical aperture (NA) output fibers. For instance, there may be 8 output fibers 602 that are part of an 8 pack with a pumping pack of 5200 W at 915 nm. The output fibers 602 may be connected to a power combiner 604 (e.g., an 8:1 power combiner) that are configured to combine the lasers from the output fibers 602. The power combiner 604 is coupled to a fiber grating mirror 606 (e.g., a 20/400 non polarization-maintaining (PM) 3 nm Fiber Bragg Grating high reflectance (HR) mirror). The fiber grating mirror 606 is configured to form a stable laser cavity having a laser wavelength selected by a low reflector. The fiber grating mirror 606 is coupled to a gain fiber 608 (e.g., a Yb doped non PM gain fiber) that is configured to be a source of optical gain within the laser device. The gain fiber 608 is coupled to another fiber grating mirror 610 (e.g., a 20/400 non PM 3 nm Fiber Bragg Grating output coupling (OC) mirrors). The fiber grating mirror 610 is coupled to an end cap 612 (e.g., a 2×15 mm AR coated precision aligned end cap). The end cap 612 may be configured to reduce the intensity at the air-to-glass interface of the laser device to prevent potential damage from high-power sources.

The depicted structure for the laser device allows for lower-cost laser diodes to be used in fewer laser channels with simpler laser oscillator structures, resulting in an overall lower cost. It will be appreciated, however, that other pumping structures may also be used in other exemplary embodiments, and the present invention is not limited to the structure illustrated in FIG. 6.

In some variations, the anti-UAV system 300 uses wider linewidth fiber laser oscillators, which includes using longer fiber lasers. For example, instead of having 5-10 m fibers as would be used in a conventional SBC grating approach, in some instances, the anti-UAV system 300 may utilize a 20-30 m length of fiber. By using this relatively long length of fiber, 915 nm pumping may be utilized (instead of the 976 nm pumping that is typical of DE fiber lasers). 915 nm pump lasers are about 20% less expensive than 976 nm pump lasers, and the very broad absorption plateau between 915 nm and 940 nm means that the wavelength of the pump diodes does not have to be carefully chosen to match the sharp 976 nm absorption peak, nor do they need to be stabilized by an internal grating which would add cost and reduce efficiency. Further, due to the longer fiber and 915 nm pumping, the amplifier output is much less sensitive to the temperature of the pump diodes, which shift in wavelength by 0.3 nm/Celsius (C). This means that a wider portion of the pump diode production window may be utilized. In addition, the pump laser diodes may heat up during the 10-20 seconds (sec) operating window and then cool down between pulses. This allows for a lower volume water flow which reduces the system infrastructure in terms of pump pressure and flow, which makes the overall system smaller and less expensive.

In some examples, each fiber laser device 304-312 (e.g., each module/channel) may be housed into its own 19 inch (in) rack module with an estimated height of 5 rack units (RU). A 20-30 kW system having a stack of five 4-6 kW modules may be fitted in an electronics rack housing approximately 44 in tall and 24 in deep, providing a relatively compact design relative to existing approaches. The AC to DC power supply and water supply would be separate from the anti-UAV system 300, and as mentioned above, further space savings with respect to the water supply may also be achieved.

Figure 7:
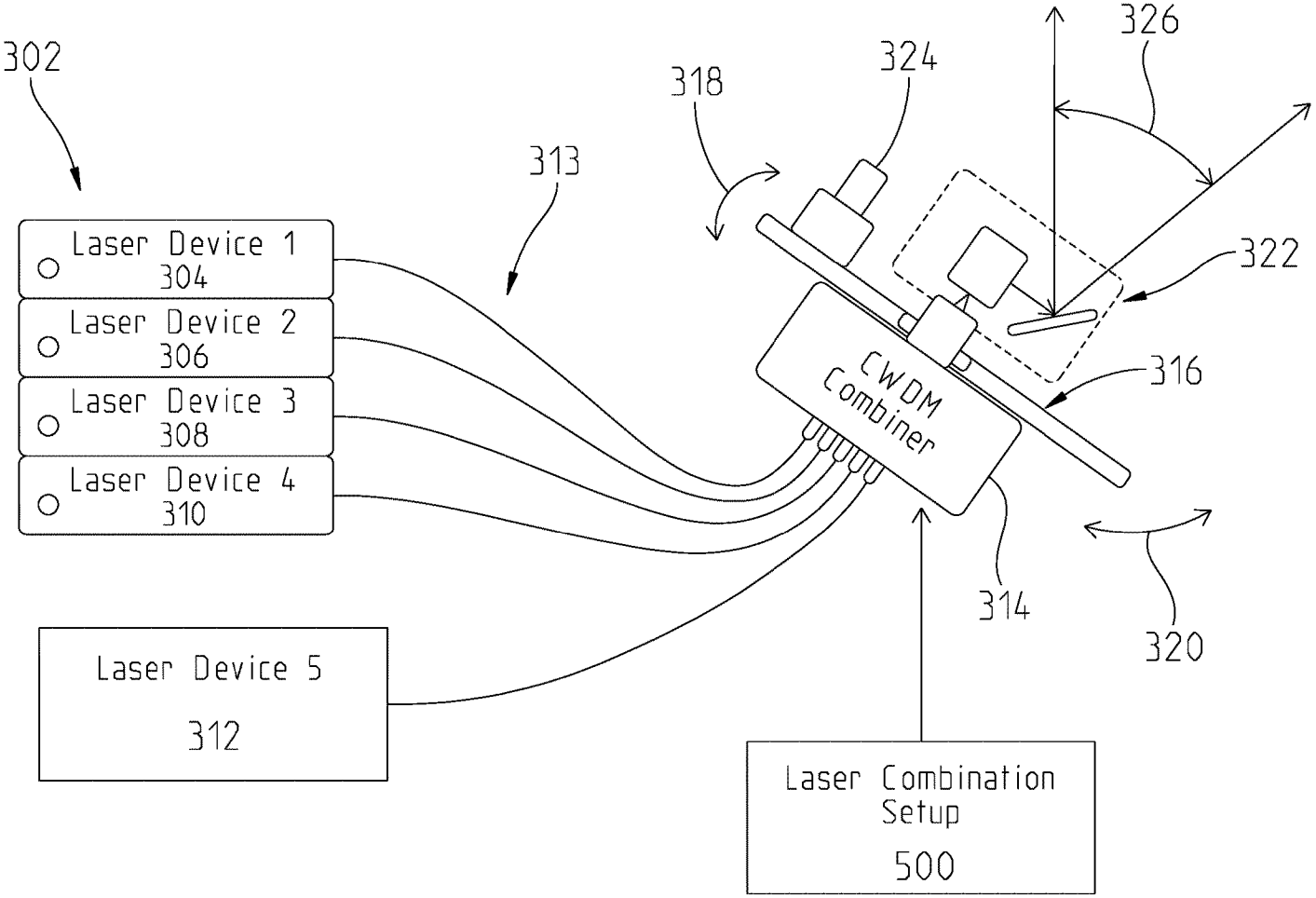
FIG. 7 shows another exemplary anti-UAV laser system for a directed energy application according to one or more examples of the present application.

FIG. 7 shows another exemplary anti-UAV laser system for a directed energy application according to one or more examples of the present application. In particular, FIG. 7 shows the anti-UAV system 300 with the laser combination setup of FIG. 5 and the individual fiber laser device 312 of FIG. 6. For instance, the CWDM combiner 314 may include the laser combination setup 500 of FIG. 5 as well as a beam expander. It will be appreciated, however, that FIG. 7 is just one exemplary embodiment, and that the principles of the present invention are not limited thereto.

In some instances, the capturing device 324 may include a processor and/or memory configured to perform anti-UAV applications. For example, the capturing device 324 may be configured to control the anti-UAV system 300 so as to perform anti-UAV applications. For instance, the processor of the capturing device 324 may provide instructions to the laser stack 302 to produce a plurality of laser beams. Additionally, and/or alternatively, the processor may provide instructions to the beam director platform 316 to adjust the elevator/azimuth of the beam director platform 316 and/or converge the last beam output by the CWDM combiner 314 so as to direct the laser beam onto the detected UAV.

Figure 8:
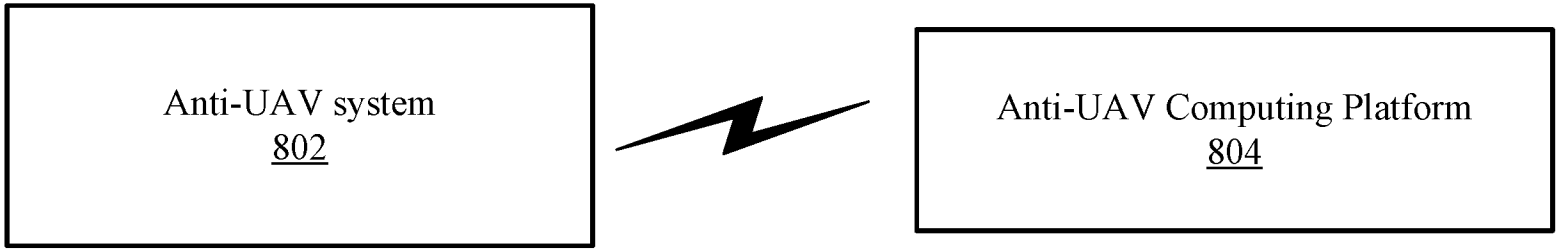
FIG. 8 shows a simplified block diagram depicting an environment for anti-UAV applications according to one or more examples of the present application.

In other instances, an external system such as the computing platform described above may be used to perform anti-UAV applications. FIG. 8 shows a simplified block diagram depicting an environment for anti-UAV applications according to one or more examples of the present application. Although the entities within environment 800 may be described below and/or depicted in the FIGS. as being singular entities, it will be appreciated that the entities and functionalities discussed herein may be implemented by and/or include one or more entities.

Referring to FIG. 8, the environment 800 includes an anti-UAV system 802 and an anti-UAV computing platform 804. The anti-UAV system 802 may be anti-UAV system 300 described in FIG. 3 above. The anti-UAV system 802 may be in communication with the anti-UAV computing platform 804 via a wired connection and/or a wireless connection.

The anti-UAV computing platform 804 includes one or more computing devices, computing platforms, systems, servers, processors, memory and/or other apparatuses capable of controlling the anti-UAV system 802 and/or performing anti-UAV applications. In some variations, the anti-UAV computing platform 804 may be implemented as engines, software functions, and/or applications. In other words, the functionalities of the anti-UAV computing platform 804 may be implemented as software instructions stored in storage (e.g., memory) and executed by one or more processors.

In operation, the anti-UAV computing platform 804 (e.g., the computing platform) may perform anti-UAV applications, which are described above. For instance, the anti-UAV computing platform 804 may provide instructions to the laser stack 302 to produce a plurality of laser beams. Additionally, and/or alternatively, the processor may provide instructions to the beam director platform 316 and/or the CWDM combiner 314 to adjust the elevation/azimuth of the beam director platform 316 and/or converge the last beam output by the CWDM combiner 314 so as to direct the laser beam onto the detected UAV.

Figure 9:
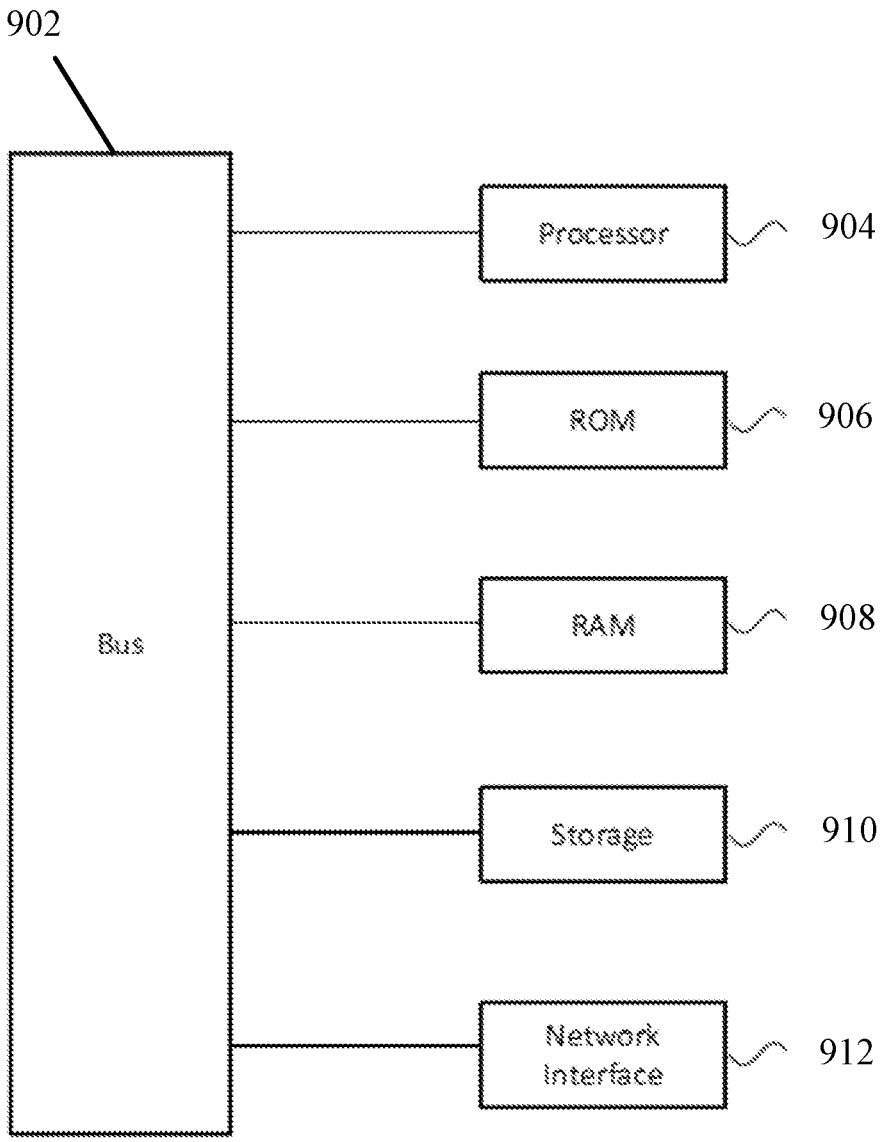
FIG. 9 is a simplified block diagram of one or more devices or systems within the exemplary environment of FIG. 8.

FIG. 9 is a simplified block diagram of an exemplary system (e.g., the anti-UAV computing platform 804) within the exemplary environment of FIG. 8. The system 900 includes one or more processors 904, such as one or more CPUs, controller, and/or logic, that executes computer executable instructions for performing the functions, processes, and/or methods described herein. In some examples, the computer executable instructions are locally stored and accessed from a non-transitory computer readable medium, such as storage 910, which may be a hard drive or flash drive. Read Only Memory (ROM) 906 includes computer executable instructions for initializing the processor 904, while the random-access memory (RAM) 908 is the main memory for loading and processing instructions executed by the processor 904. The network interface 912 may connect to a wired network or cellular network and to a local area network or wide area network. The device/system 900 may also include a bus 902 that connects the processor 904, ROM 906, RAM 908, storage 910, and/or the network interface 912. The components within the device/system 900 may use the bus 902 to communicate with each other. The components within the system 900 are merely exemplary and might not be inclusive of every component, server, device, computing platform, and/or computing apparatus within the system 900. Additionally, and/or alternatively, the system 900 may further include components that might not be included within every entity of environment 800.

Figure 10:
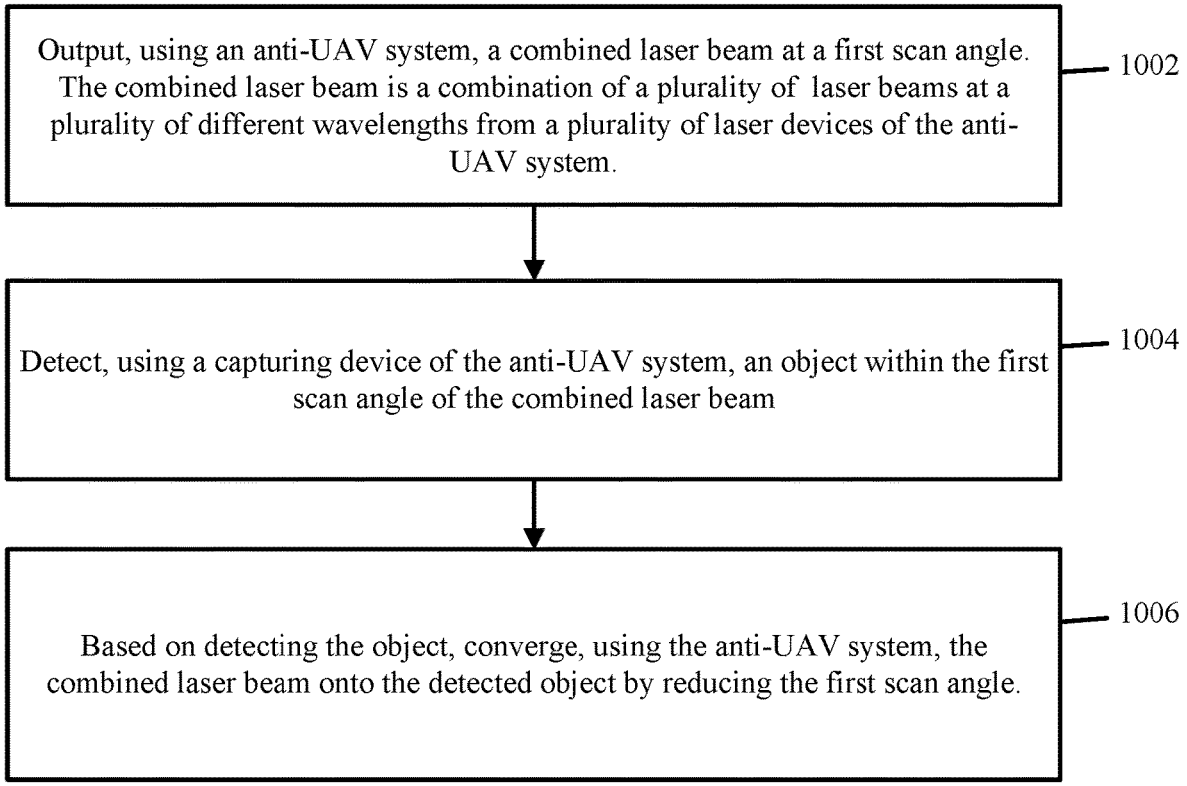
FIG. 10 depicts an exemplary process for performing anti-UAV applications in accordance with one or more examples of the present disclosure.

FIG. 10 depicts an exemplary process for performing anti-UAV applications in accordance with one or more examples of the present disclosure. The below describes process 1000 being performed by the anti-UAV computing platform 804. However, as mentioned above, the process 1000 may be performed a processor of the capturing device 324 shown in FIG. 3. However, it will be recognized that any of the following blocks may be performed in any suitable order and that the process 1000 may be performed in any environment and by any suitable computing device.

At block 1002, the anti-UAV computing platform 804 outputs, using an anti-UAV system (e.g., the anti-UAV system 300), a combined laser beam at a first scan angle. The combined laser beam is a combination of a plurality of laser beams at a plurality of different wavelengths from a plurality of laser devices (e.g., laser devices 304-312) of the anti-UAV system. For example, referring to FIG. 3, the anti-UAV computing platform 804 may output a combined laser beam (e.g., a laser beam from a DE-HEL) to scan for an object such as a UAV. The anti-UAV computing platform 804 may provide instructions to the plurality of laser devices 304-312 to each output a laser beam. Each of the laser devices 304-312 may output a laser beam at a different wavelength (e.g., wavelengths 1030 nm to 1070 nm).

The anti-UAV system 300 includes a CWDM combiner 314 that combines the plurality of laser beams into a single, combined laser beam. For instance, as shown in FIG. 5, the CWDM combiner 314 may include a plurality of film filters that are used to combine the plurality of laser beams into a single, combined laser beam. The anti-UAV system 300 outputs the single, combined laser beam. Initially, as mentioned above, the laser beam output from the anti-UAV system 300 may be used to scan for an object such as a UAV. As such, the anti-UAV computing platform 804 may output the single laser beam at a first scan angle (e.g., a wider scan angle), which is associated with a scan range. In other words, the single laser beam may be diverged into a wider scan angle so as to increase the scan range for detecting the UAV. In some instances, by diverging the laser beam, the single laser beam may have power level below the amount adequate to disable the UAV (e.g., a power level below 20 kW to 30 kW). Then, as will be described below, after detecting the object (e.g., the UAV), the anti-UAV computing platform 804 may converge the single laser beam by decreasing the scan angle so as to direct more power onto the detected object and disable/destroy the object.

Additionally, and/or alternatively, the anti-UAV system 300 includes a beam director platform 316 includes elevation adjustment and azimuth adjustment. The anti-UAV computing platform 804 may provide instructions to adjust the elevation (e.g., height) and/or azimuth (e.g., angle) of the combined laser beam from the CWDM combiner 314.

At block 1004, the anti-UAV computing platform 804 detects, using a capturing device (e.g., capturing device 324) of the anti-UAV system, an object within the first scan angle of the combined laser beam. For example, the capturing device may capture images, frames, videos, and/or other data associated with the scan region of the combined laser beam. For instance, if the detected object is within the scan region of the first scan angle, the detected object may reflect the combined laser beam and the capturing device may capture feedback (e.g., a captured image or frame) of the reflection of the combined laser beam as the combined laser beam interacts with the detected object. The anti-UAV computing platform 804 may receive an indication from the capturing device indicating the detected object based on the reflection of the combined laser beam.

In some instances, the capturing device may include and/or use a filter for detecting the object. For example, as mentioned previously, the plurality of laser beams are within a certain wavelength window (e.g., between 1025 nm and 1080 nm window). The capturing device may use a filter so as to filter out light that is outside of a window associated with the laser beams (e.g., a filter for the 1025 nm to 1080 nm window). Therefore, by using the filter, this may reduce the image processing of the anti-UAV computing platform 804 for detecting the object.

At block 1006, based on detecting the object, the anti-UAV computing platform 804 converges, using the anti-UAV system, the combined laser beam onto the detected object by reducing the first scan angle. For example, based on detecting the object, the anti-UAV computing platform 804 provides instructions to the anti-UAV system to converge the combined laser beam onto the detected object. To put it another way, after detecting the object, the anti-UAV computing platform 804 may provide instructions to the anti-UAV computing platform 804 to reduce the scan angle, and thus the scan region, of the combined laser beam from a first scan angle. For instance, by reducing the scan angle, additional power from the laser beam may be directed to the detected object. The anti-UAV computing platform 804 may continuously reduce the scan angle and converge the combined laser beam until the power of the laser beam is sufficient to disable or destroy the object (e.g., the UAV). For example, the anti-UAV computing platform 804 may continuously reduce the scan angle and converge the combined laser beam until the power reaches 20 kW to 30 kW, which is adequate to disable or destroy the UAV.

In some instances, the anti-UAV computing platform 804 may cause a continuous combined laser beam to be converged onto the detected object. In other instances, the anti-UAV computing platform 804 may generate a plurality of combined laser beams at different scan angles. Each laser beam may have a scan angle that is less than the previously generated laser beam so as to converge the laser beam onto the detected object.

In some examples, the anti-UAV computing platform 804 may provide instructions to adjust the elevation (e.g., height) and/or azimuth (e.g., angle) of the combined laser beam to direct the combined laser beam onto the object. For instance, the capturing device may detect the movement of the UAVs. Based on the movement, the anti-UAV computing platform 804 may provide instructions for elevation adjustment or azimuth adjustment so as to direct the combined laser beam onto the UAV to disable or destroy the UAV. In some variations, the anti-UAV computing platform 804 may use the 2-axis scan head 322 and/or the beam expander of the CWDM combiner 314 to converge and/or diverge the combined laser beam onto the object. For example, the anti-UAV computing platform 804 may provide instructions to the beam expander to diverge or converge the combined laser beam at different scan angles to detect the object and/or disable/destroy the object.

In some instances, blocks from process 1000 may be continuously repeated until the UAV is disabled or destroyed. For example, the anti-UAV computing platform 804 may reduce the scan angle and/or the scan region in steps or blocks. Then, based on detecting the object, the anti-UAV computing platform 804 may further reduce the scan angle/scan region and/or provide instructions for elevation adjustment or azimuth adjustment. The anti-UAV computing platform 804 may continuously reduce the scan angle/scan region and/or provide instructions for elevation adjustment or azimuth adjustment until sufficient power is directed onto the UAV to disable or destroy the UAV.

Figure 11:
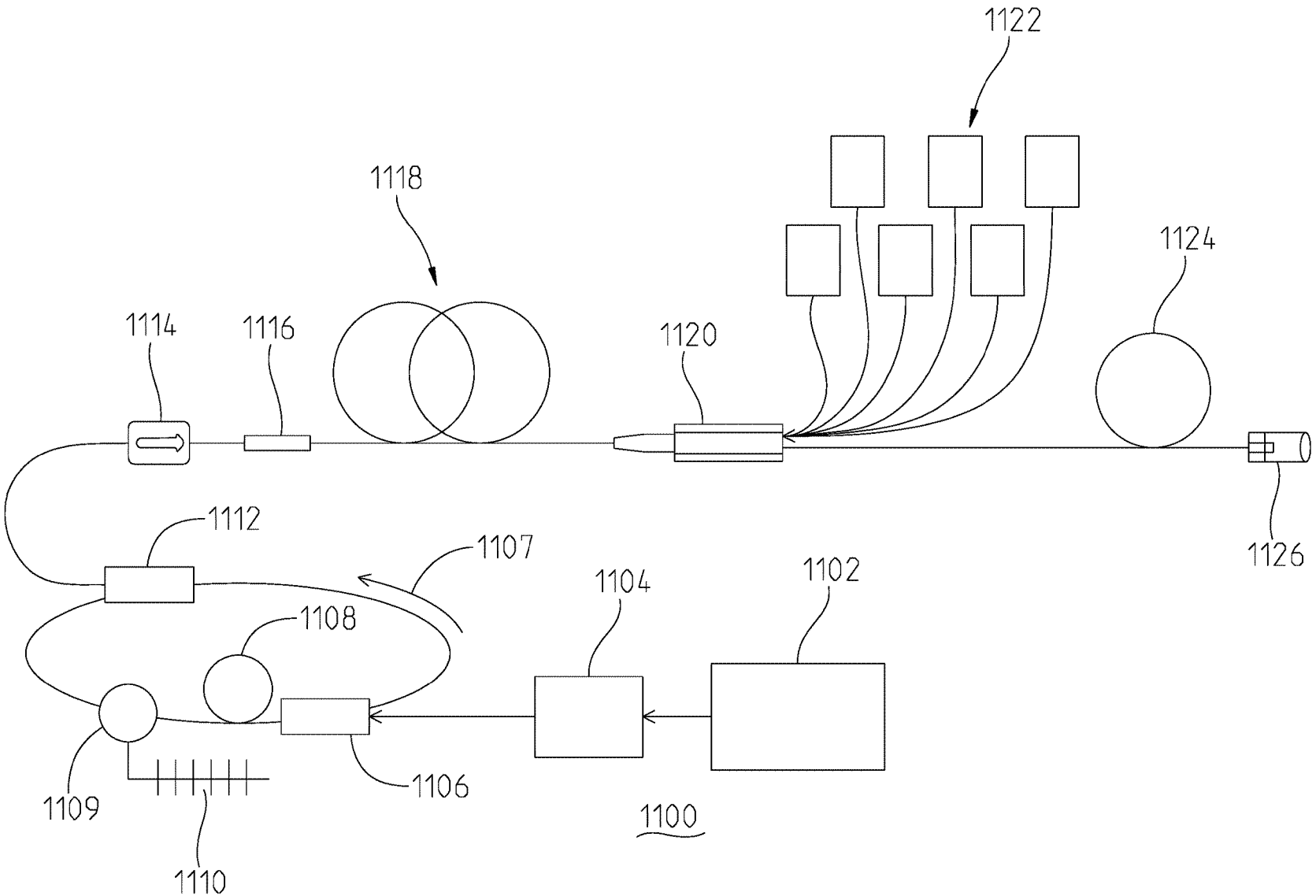
FIG. 11 shows another example of an individual fiber laser module of the anti-UAV laser system according to one or more examples of the present application.

FIG. 11 shows another example of an individual fiber laser module of the anti-UAV laser system according to one or more examples of the present application. In particular, the individual fiber laser module 1100 includes two major components. The first is a ring laser oscillator, which comprises a wavelength division multiplexed (WDM) combiner 1106, an adjustable tap coupler 1112, a circulator 1109 (e.g., a Faraday circulator), and a first gain fiber 1108. The second is a power amplifier (e.g., a second gain fiber 1118), which may be in a master oscillator power amplifier (MOPA) configuration. Based on the ring laser oscillator and the power amplifier, the system is optimized to satisfy the requirements of greater than 3.5 kW of output power and a line width of the output beam of less than 2 nm. The MOPA configuration (e.g., the power amplifier) further allows for an optimization of each section independently to ensure the narrowest linewidth at the highest power.

The individual fiber laser module 1100 (e.g., a laser device such as laser devices 304-312 of the anti-UAV system 300) includes a seed driver with power supply (PS) 1102 that provides an output to the seed laser pump 1104. The seed laser pump 1104 may be a 60 W laser pump. The seed laser pump 1104 provides an output (e.g., a pump light) to the ring laser oscillator. The ring laser oscillator includes a first gain fiber 1108 (e.g., a ring fiber amplifier) where a pumped gain fiber is situated between a tap based output coupler (e.g., adjustable tap coupler 1112) and a Faraday circulator 1109. The WDM combiner 1106 is within the ring laser oscillator that loops around in the signal direction 1107. For instance, the ring laser oscillator includes a WDM combiner 1106, the adjustable tap coupler 1112, a Faraday circulator 1109, and a first gain fiber 1108. The Faraday circulator 1109 is coupled to a Fiber Bragg Grating (FBG) high reflectance (HR) mirror 1110. The FBG HR mirror 1110 may be a 10/125 μm non PM, less than 0.1 nm FBG HR mirror. The first gain fiber 1108 may be a 10/125 μm Yb gain fiber.

In operation, the seed driver 1102 and the seed laser pump 1104 may generate a 976 nm wavelength stabilized pump laser beam (e.g., pump light) with a 105/125 nm 0.15 NA output. The output (e.g., the pump light) is directed towards the WDM combiner 1106 where the output is added to the fiber (e.g., the fiber signal) within the ring laser oscillator. The pump light (e.g., output from the seed laser pump 1104) is moved through a Yb doped 10/125 μm double clad gain fiber (e.g., the first gain fiber 1108) where the pump light is absorbed and creates an optical gain within the fiber. The optical circulator 1109 takes input light, and directs the light to a fiber Bragg reflector (e.g., FBG HR mirror 1110) where the reflection is directed to the output towards the gain fiber (e.g., the first gain fiber 1108). In this embodiment, the signal fiber may travel in the opposite direction of the pump light. For instance, the signal fiber (e.g., the signal light) may propagate in a first direction (e.g., the signal direction) indicated by the arrow 1107 and the pump light from the seed laser pump 1104 may propagate in the opposite direction of the signal fiber (e.g., opposite of the signal direction 1107). In other words, the core of first gain fiber 1108 may carry the signal light in the direction 1107, and the pump light may be carried on the exterior portion of the first gain fiber 1108 (e.g., exterior of the core) in the opposite direction.

The amplified light travels to the tap coupler 1112, which splits 95% of the output towards the power amplifier (e.g., towards the second gain fiber 1118) and 5% recirculates towards the circulator 1109. The tap coupler 1112 may be adjustable such that different tap ratios may be selected to optimize the efficiency and wavelength characteristics of the ring laser oscillator (e.g., a 90% and 10% split). Further, the non-reciprocal Faraday Rotation nature of the circulator 1109 ensures that light travels in only one direction in the ring laser oscillator. Additionally, and/or alternatively, the placement of the circulator 1109 after the tap output coupler 1112 places the circulator 1109 in a low power portion of the ring laser oscillator such that lower power components may be used. The FBG mirror 1110 may be selected to set the laser wavelength and linewidth for each oscillator. As such, for the different channels/devices of the anti-UAV system (e.g., the laser devices 304-312 of the anti-UAV system 300), a different FBG mirror 1110 may be used for the different laser wavelengths and linewidths. The ring laser oscillator is used as it may offer stable narrow linewidth operation and a single low power FBG may be used to select a wide array of oscillators. In some instances, the single FBG mirror 1110 may be replaced with a tunable wavelength structure to be able to electronically shift and tune the center operating frequency over the operating band.

After the ring oscillator, the tap coupler 1112 outputs a signal (e.g., fiber signal) to an isolator 1114. The isolator 1114 is configured to prevent signal or light from going backwards and entering the ring laser oscillator. The outputted signal may be additionally amplified to 30 W and a linewidth of under 0.2 nm. For example, after the laser beam goes through an isolator 1114, the signal is provided to a power stripper 1116. The power stripper 1114 is constructed of a glass fiber section where the fiber buffer has been removed and the glass frosted using a HF etch, and is configured to remove any unabsorbed pump light. For instance, the power stripper 1116 may be used to absorb the pump light since unabsorbed pump light may damage one or more components of the laser device/module 1110. Afterwards, the signal light reaches the power amplifier (e.g., the second gain fiber 1118). The second gain fiber 1118, which may be a MOPA configuration, may include a mode adapter at its input that expands the light from the 10 μm core fiber (e.g., the core of the first gain fiber 1108) to the 20 μm core fiber of the Yb doped gain fiber (e.g., the second gain fiber 1118). The power amplifier 1118 may be a counter pumped amplifier configuration, which has reduced non-linearities. The power amplifier 1118 may have a low signal spreading non linearity as compared to a co-pumped amplifier.

Subsequently, the output (e.g., the fiber signal) from the power amplifier 1118 may be provided the one or more signal combiners 1120. For instance, the signal combiners 1120 may be a 7 to 1 pump combiner and/or a 6+1:1 pump signal combiner. The signal combiners 1120 are configured to combine signals from the power amplifier 1118 and a plurality of laser diodes 1122. For instance, six laser diodes 1122 are shown for simplicity, but the laser device 1100 may include additional laser diodes and/or additional signal combiners 1120. For example, the six laser diodes 1122 may provide pump light to the signal combiners 1120 (e.g., from the right to left of the signal combiners 1120), and the power amplifier 1118 may provide signal light to the signal combiners 1120 (e.g., from the left to right of the signal combiners 1120). Based on the pump light/signal light from the laser diodes 1122 and the power amplifier 1118, an output signal may be provided to the delivery fiber 1124. The delivery fiber 1124 may be a passive 20/400 delivery fiber, and connected to a glass end cap 1126. The glass end cap 1126 outputs the laser beam at a specific wavelength to the CWDM combiner (e.g., the CWDM combiner 314 of the anti-UAV system 300). In some instances, a collimator may be operatively coupled to the end of the glass end cap 1126 to increase the beam to a desired size (e.g., width).

In some examples, the plurality of laser diodes 1122 may include twenty-eight laser diodes. For instance, the counter pumping configuration (e.g., the configuration that provides pump light to the signal combiners 1120) may include twenty-eight 976 nm non wavelength stabilized fiber coupled to pump lasers for a total pumping power of 4200 W. The gain fiber 1118 may be set for approximately 15 dB of total absorption with about 25 m of gain fiber length. Each of the pump lasers (e.g., pump diodes 1122) is coupled into a 7 to 1 pump combiner 1120 and the resulting output fibers is directed to 4 ports on the 6+1:1 pump signal combiner 1120. In other words, there may be four total pump combiners 1120, with each pump combiner 1120 including seven laser diodes of the twenty-eight laser diodes 1122. At the input side of the signal combiners 1120 may be an unabsorbed pump power stripper 1114, which is constructed of a glass fiber section where the fiber buffer has been removed and the glass frosted using a HF etch to remove any unabsorbed pump light from the laser diodes 1122. In some variations, the second gain fiber 1118 may be a 20/400 um 0.46 NA Yb doped non PM gain fiber with a 0.6 NA in the core and a low index plastic coating for the outer pump cladding.

In some variations, the ring laser oscillator of FIG. 11 (e.g., the ring laser oscillator comprising the wavelength division multiplexed (WDM) combiner 1106, the adjustable tap coupler 1112, the circulator 1109, and the first gain fiber 1108) may be replaced with a linear laser oscillator. For example, rather than including a ring laser oscillator, the laser device 1100 may include a linear oscillator such as the example shown in FIG. 6 above, and use the linear oscillator for outputting a laser beam to the CWDM combiner 314.

It will be appreciated that the various machine-implemented operations described herein may occur via the execution, by one or more respective processors, of processor-executable instructions stored on a tangible, non-transitory computer-readable medium, such as a random access memory (RAM), read-only memory (ROM), programmable read-only memory (PROM), and/or another electronic memory mechanism. Thus, for example, operations performed by any device described herein may be carried out according to instructions stored on and/or applications installed on the device, and via software and/or hardware of the device.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims)

are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A system for disabling or destroying an unmanned aerial vehicle (UAV), comprising:

an anti-UAV system comprising:

a plurality of laser devices configured to generate a plurality of laser beams at a plurality of different wavelengths; and a coarse wavelength division multiplexing (CWDM) combiner configured to combine the plurality of laser beams from the plurality of laser devices into a combined laser beam; and an anti-UAV computing platform configured to:

based on detecting the UAV, direct, using the anti-UAV system, the combined laser beam from the CWDM combiner onto the detected UAV.

2. The system of claim 1, wherein the anti-UAV computing platform is further configured to:

output, using the anti-UAV system, the combined laser beam at a first scan angle; and detect the UAV based on outputting the combined laser beam at the first scan angle, and wherein directing the combined laser beam onto the detected UAV comprises converging the combined laser beam onto the detected UAV by reducing the first scan angle.

3. The system of claim 2, wherein the plurality of different wavelengths of the plurality of laser devices are within a wavelength window, and wherein detecting the UAV is based on using a filter associated with the wavelength window to filter out pixels outside of the wavelength window.

4. The system of claim 2, wherein the CWDM combiner comprises a beam expander configured to converge or diverge the combined laser beam, and wherein the anti-UAV computing platform is configured to output the combined laser beam at the first scan angle by directing the beam expander to diverge the combined laser beam to the first scan angle.

5. The system of claim 4, wherein the anti-UAV computing platform is configured to converge the combined laser beam onto the detected UAV by:

causing the beam expander to direct additional laser power onto the detected UAV based on reducing a scan angle of the combined laser beam from the first scan angle.

6. The system of claim 1, wherein the CWDM combiner comprises a plurality of thin film filters, wherein the plurality of thin film filters comprises:

a first thin film filter configured to combine a first laser beam from a first laser device, of the plurality of laser devices, with a second laser beam from a second laser device, of the plurality of laser devices, to generate a first combined laser beam; and a second thin film filter configured to combine the first combined laser beam with a third laser beam from a third laser device, of the plurality of laser devices, to generate a second combined laser beam, wherein the combined laser beam is based on the second combined laser beam.

7. The system of claim 6, wherein the plurality of thin film filters comprises:

a third thin film filter configured to combine the second combined laser beam with a fourth laser beam from a fourth laser device, of the plurality of laser devices, to generate a third combined laser beam; and a fourth thin film filter configured to combine the third combined laser beam with a fifth laser beam from a fifth laser device, of the plurality of laser devices, to generate a fourth combined laser beam, wherein the combined laser beam is the fourth combined laser beam.

8. The system of claim 1, wherein each of the plurality of laser devices comprises a Ytterbium (Yb) laser medium.

9. The system of claim 1, wherein each of the plurality of laser devices comprises an Erbium (Er) laser medium or a Thulium (Tm) laser medium.

10. The system of claim 1, wherein the anti-UAV system further comprises:

a movable beam director platform configured for elevation adjustment and azimuth adjustment, wherein the anti-UAV computing platform is configured to converge the combined laser beam onto the detected UAV by:

adjusting an elevation or an azimuth angle of the movable beam director platform.

11. The system of claim 10, wherein the anti-UAV computing platform is configured to detect the UAV based on receiving an image from an capturing device indicating the UAV, and wherein the adjusting the elevation or the azimuth angle of the movable beam director platform is based on the image from the capturing device.

12. The system of claim 10, wherein the movable beam director platform comprises:

a two-axis scan head configured to direct the combined laser beam.

13. The system of claim 1, wherein a laser device of the plurality of laser devices comprises a ring laser oscillator.

14. The system of claim 13, wherein the ring laser oscillator comprises a wavelength division multiplexed (WDM) combiner, an adjustable tap coupler, a first gain fiber, and a circulator.

15. The system of claim 14, wherein the laser device further comprises a second gain fiber configured to output a fiber signal and coupled to an output of the ring laser oscillator, a plurality of laser diodes configured to provide pump light, and a signal combiner configured to generate an output based on the pump light and the fiber signal from the second gain fiber.

16. A method for disabling or destroying an unmanned aerial vehicle (UAV), comprising:

generating, by a plurality of laser devices of an anti-UAV system, a plurality of laser beams at a plurality of different wavelengths;

combining, by the anti-UAV system and using a coarse wavelength division multiplexing (CWDM) combiner, the plurality of laser beams from the plurality of laser devices into a combined laser beam; and based on detecting the UAV, directing, by the anti-UAV system, the combined laser beam from the CWDM combiner onto the detected UAV.

17. The method of claim 16, wherein generating the plurality of laser beams comprises generating, by the plurality of laser devices, the plurality of laser beams at the plurality of different wavelengths, wherein each of the plurality of laser devices comprises a Ytterbium (Yb) laser medium.

18. The method of claim 16, wherein generating the plurality of laser beams comprises generating, by the plurality of laser devices, the plurality of laser beams at the plurality of different wavelengths, wherein each of the plurality of laser devices comprises an Erbium (Er) laser medium or a Thulium (Tm) laser medium.

19. The method of claim 16, wherein the method further comprises:

outputting, using the anti-UAV system, the combined laser beam at a first scan angle;

detecting the UAV based on outputting the combined laser beam at the first scan angle, and wherein directing the combined laser beam onto the detected UAV comprises converging the combined laser beam onto the detected UAV by reducing the first scan angle.

20. An anti-unmanned aerial vehicle (UAV) computing platform, comprising:

one or more processors; and a non-transitory computer-readable medium having processor-executable instructions stored thereon, wherein the processor-executable instructions, when executed by the one or more processors, facilitate:

providing instructions to output a combined laser beam at a first scan angle, wherein a coarse wavelength division multiplexing (CWDM) combiner combines a plurality of laser beams that are at a plurality of different wavelengths into the combined laser beam;

detecting an unmanned aerial vehicle (UAV) within the first scan angle of the combined laser beam based on a reflection of the combined laser beam; and based on detecting the UAV, providing instructions to the CWDM combiner to converge the combined laser beam onto the detected UAV by reducing the first scan angle.

* * * * *